US005684364A

United States Patent [19]

Heppinstall et al.

[11] Patent Number: 5,684,364

[45] Date of Patent: Nov. 4, 1997

[54] ELECTRON BEAM TUBE COLLECTOR HAVING CERAMIC SHIELDING MEANS

[75] Inventors: Roy Heppinstall; Steven Bardell; Stuart William Andrews, all of Essex, United Kingdom

[73] Assignee: EEV Limited, Essex, United Kingdom

[21] Appl. No.: 246,224

[22] Filed: May 18, 1994

[30] Foreign Application Priority Data

Jun. 3, 1993 [GB] United Kingdom ..... 9311419

[51] Int. Cl.[6] ..... H01J 23/027

[52] U.S. Cl. ..... 315/5.38

[58] Field of Search ..... 315/5.38

[56] References Cited

U.S. PATENT DOCUMENTS

| | | | |
|---|---|---|---|
| 3,368,104 | 2/1968 | McCullough | 315/5.38 |
| 3,824,425 | 7/1974 | Rowls, Jr. | 315/5.38 X |
| 4,398,122 | 8/1993 | Gosset | 315/5.38 |
| 4,527,092 | 7/1985 | Ebihara | 315/5.38 |
| 5,177,394 | 1/1993 | Kubo | 315/5.38 X |
| 5,418,425 | 5/1995 | Bachmor et al. | 315/5.38 |

*Primary Examiner*—Benny T. Lee
*Attorney, Agent, or Firm*—Donald C. Casey

[57] ABSTRACT

In an electron beam tube such as a klystron, a vacuum seal comprises a ceramic cylindrical wall on which are brazed metal rings which are welded to flares and fixed to electrodes and of a collector. Ceramic rings and are located between the metal ring and the electrodes. The cylindrical wall includes inner flanges which overlap the inner peripheries of the metal rings hence reducing the likelihood of arcing occurring between them and other parts of the arrangement at different potentials. In other embodiments of the invention, the ceramic rings are extended to shield the inner edges of the metal rings or a separate ceramic tube is positioned within the metal rings to provided shielding.

20 Claims, 4 Drawing Sheets

ELECTRON BEAM TUBE COLLECTOR HAVING CERAMIC SHIELDING MEANS

FIELD OF THE INVENTION

This invention relates to electron beam tubes and more particularly, but not exclusively, to the construction of collectors employed in klystrons and other linear beam tubes.

BACKGROUND TO THE INVENTION

In one type of collector used in klystrons and other linear beam tubes, such as travelling wave tubes, a plurality of annular electrodes are disposed along the length of the collector. Adjacent electrodes are maintained at different potentials to reduce the impact energy of the electrons at the electrode surfaces, thus providing an energy saving collector.

The interior of the collector is maintained at near high vacuum. The vacuum envelope includes cylindrical ceramic walls which extend between adjacent electrodes and permit gas tight seals to be made with them. The dimensions of the ceramic walls and the electrodes of the collector are chosen so as to reduce the possibility of arcing. If arcing occurs it may cause failure of the electrical insulation between collector electrodes which will lead to interruption of the operation, or even the destruction, of the tube.

Part of a collector of known construction is illustrated schematically in FIG. 1 which is a longitudinal section showing half of the cylindrical structure which is symmetrical about the longitudinal axis X—X. A cylindrical electrode 1 of the collector includes a radially inwardly directed portion 2 arranged to intercept electrons of the beam as they travel in the longitudinal direction, being deflected by the electrical potentials on the electrodes. A second generally cylindrical electrode 3 is located adjacent the first electrode 1 and spaced apart from it in the axial direction. Two ceramic rings 4 and 5 are located adjacent transverse surfaces of the electrodes 1 and 3 respectively. A cylindrical ceramic wall 6 is extensive between the rings 4 and 5 and is of similar radial thickness to them. A metal ring 7 is positioned between one of the ceramic rings 4 and an end face of the wall 6 to which it is brazed, the inner diameter of the ring 7 being substantially the same as that of the wall 6 and rings 4 and 5. A metal flare 8 is brazed in an annular slot 9 in the electrode 1 and includes a transverse portion which is welded to the outer periphery of the ring 7 to make a gas tight seal around its circumference. A second metal ring 10 is located between the wall 6 and second ceramic ring 5 and is welded to another flare 11 which is also brazed in a slot 12 in the electrode 3. A vacuum seal is thus obtained between the electrodes 1 and 3.

The rings 4 and 5 press against the metal rings 7 and 10, taking the axial thrust due to external pressure when the tube is under vacuum. In addition, they form a sliding abutment with the transverse surfaces of the electrodes 1 and 3 to accommodate for differential thermal expansion between the cylindrical wall 6 and the electrodes 1 and 3.

SUMMARY OF THE INVENTION

The present invention seeks to provide an improved collector assembly but may also be applied to other pans of an electron beam tube where a gas tight seal is required and where high voltages are present between adjacent metallic components.

According to the invention, there is provided an electron beam tube comprising a ceramic cylindrical wall forming pad of a vacuum envelope, a ceramic ring and a metal ring located between them, ceramic material being located radially inwardly of the metal ring and being extensive through the transverse plane in which its inner periphery is located so as to shield it.

The ceramic material shields the edge of the metal ring and hence, by employing the invention, the likelihood of arcing between the ceramic and other parts within the tube at different electrical potentials may be substantially reduced. This leads to an improvement in the operation of the tube and also permits greater freedom in choice of tube geometry. The invention is particularly advantageously applied to a collector arrangement in which electrodes of the collector operate at different potentials. The electrode potentials may differ by some tens of kilovolts. The difference in voltages may be considered large if, in the absence of the ceramic material, there is a significantly increased probability that arcing would occur between them. This is dependent on the spacings between parts at different voltages and their shapes. Part of one of the electrodes may be arranged to be co-extensive with, and radially inward of, the ceramic wall to shield the ceramic wall from electron bombardment which might otherwise cause damage. The ceramic material interposed between the metal ring and the extension to the electrode prevents electrical breakdown between the shielding part of the electrode and the metal ring.

The metal ring may be mounted on an end face of the wall, this arrangement being advantageous where the ring forms part of a collector.

In a preferred embodiment of the invention, the ceramic material shielding the ring is part of the cylindrical wall. Where two ceramic rings and metal rings are included in the arrangement, being located at each end of the cylindrical wall, then only one component of the assembly need be machined to a more complicated shape to implement the invention.

In another arrangement in accordance with the invention, the ceramic material is part of the ceramic ring. In the type of arrangement which requires two ceramic rings it is necessary to fabricate two parts of the assembly with a more complicated configuration. However, if the cylindrical wall is of relatively long axial extent, this may be a desirable arrangement to reduce the amount of ceramic material needed.

In another embodiment in accordance with the invention, the ceramic material consists of tube member located co-axially within the wall. This arrangement has the advantage that each of the ceramic components of the assembly may be a simple cylinder requiring no stepped portions.

The shielding ceramic material may abut the inner periphery of the metal ring or be spaced some distance from the inner periphery. More effective shielding may be produced if the ceramic material is in direct contact with the metal ring around its inner circumference and this configuration may also be useful for accurate location of components during assembly of the tube.

The invention may be advantageously applied to parts of electron beam tubes other than collectors. For example, in external cavity klystrons, it is necessary to have a vacuum tight seal in a region of a cavity where high voltage hold-off is required and the ceramic material for shielding may be included.

BRIEF DESCRIPTION OF THE DRAWINGS

Some ways in which the invention may be performed are now described by way of example with reference to the accompanying drawings in which.

DESCRIPTION OF PREFERRED EMBODIMENTS

Figure 1:
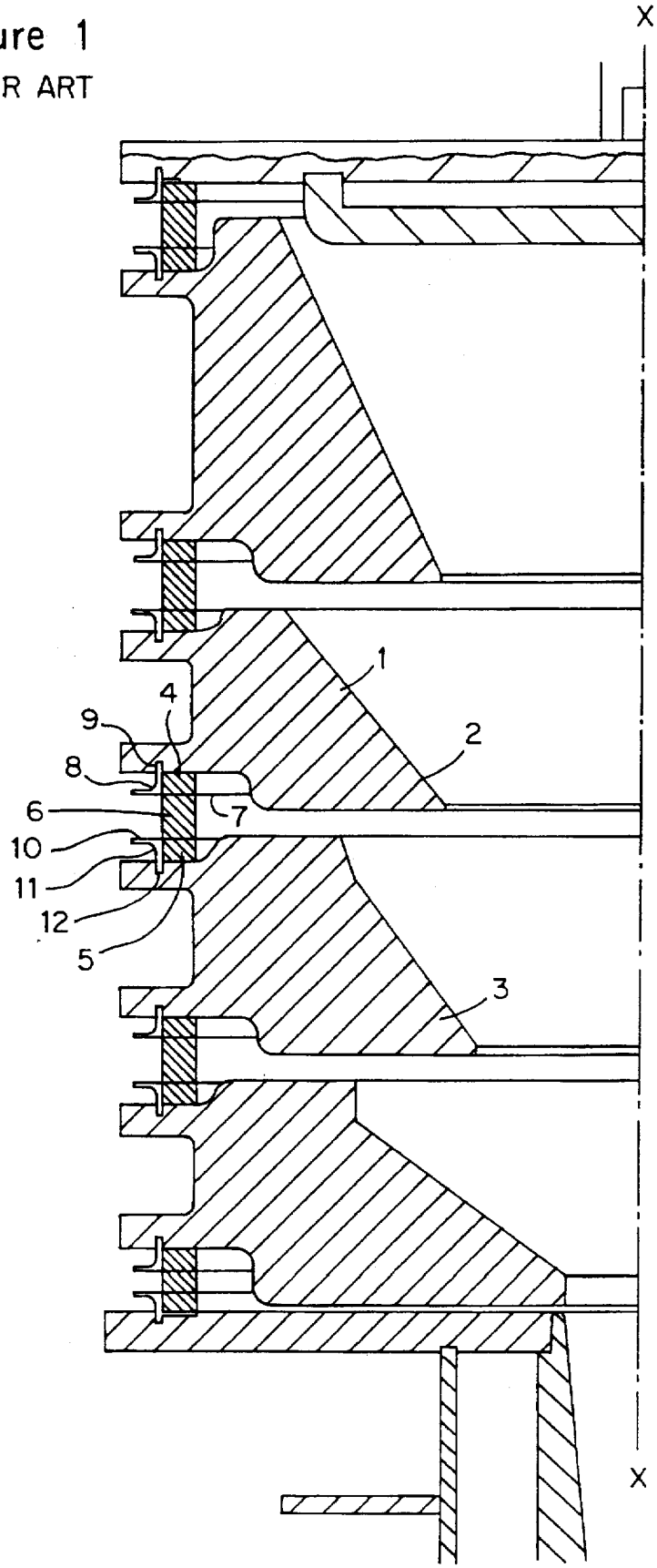
Figure 1 PRIOR ART
FIG. 1 schematically illustrates a previously known electron beam tube collector.
Figure 2:
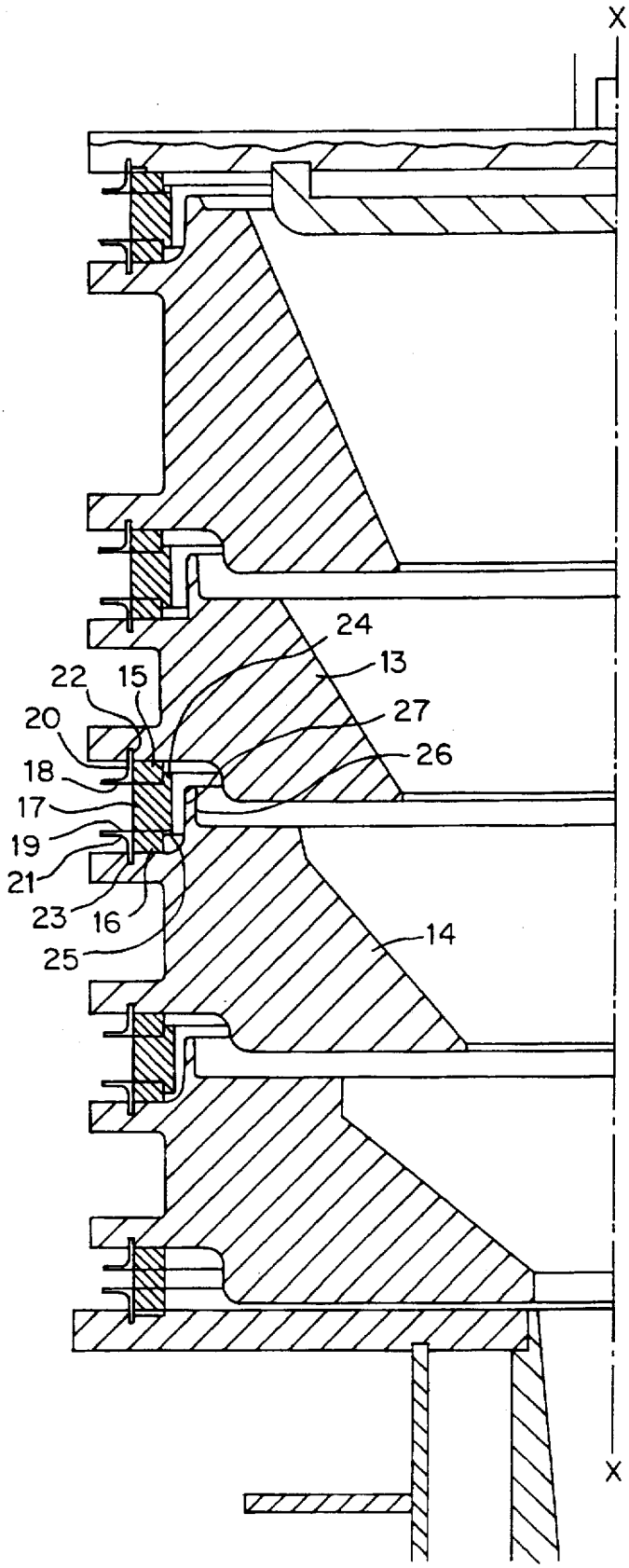
FIG. 2 schematically illustrates part of an electron beam tube in accordance with the invention.
Figure 2A:
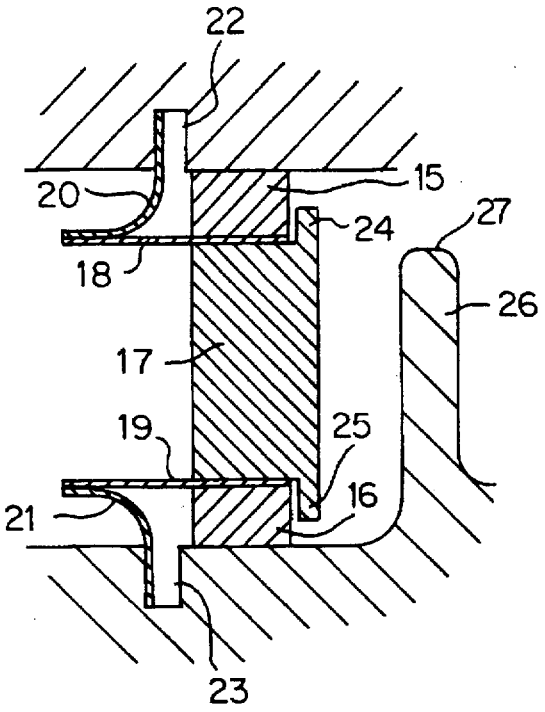
FIG. 2A is an enlarged view of part of FIG. 2.

With reference to FIGS. 2 and 2A, a multi-stage collector of a klystron or other electron beam tube includes two annular electrodes 13 and 14 shown in longitudinal section, only half the arrangement being illustrated in FIG. 2. Two ceramic rings 15 and 16 and a cylindrical ceramic wall 17 are located between the electrodes 13 and 14. Annular metal rings 18 and 19 are positioned between end faces of the wall 17 and the rings 15 and 16 respectively. The metal rings 18 and 19 are brazed to metallised end faces of the wall 17 and are welded to respective cylindrical flares 20 and 21. The flares 20 and 21 are located in annular grooves 22 and 23 in the electrodes 13 and 14 and are brazed in position to give a gas tight seal.

The ceramic wall 17 is of greater radial thickness than the ceramic rings 15 and 16, having a smaller internal diameter. The radially innermost part of the wall 17 is of greater extent in the longitudinal axial direction having inner flanges 24 and 25 extending substantially parallel to the axis X—X (see FIG. 2). The flanges 24 and 25 are of sufficient axial extent that they extend through the plane in which the rings 18 and 19 lie and are closely spaced from them in a radial direction.

One of the electrodes 14 (see FIG. 2) includes a cylindrical flange 26 which is substantially co-extensive with the inner surface of the wall 17. This protects the ceramic from electron bombardment, arcing between the end 27 of the flange and the ring 18 electrically connected to the adjacent electrode 13 being prevented by the interposed ceramic material of the flange 24 of the wall 17.

Figure 3:
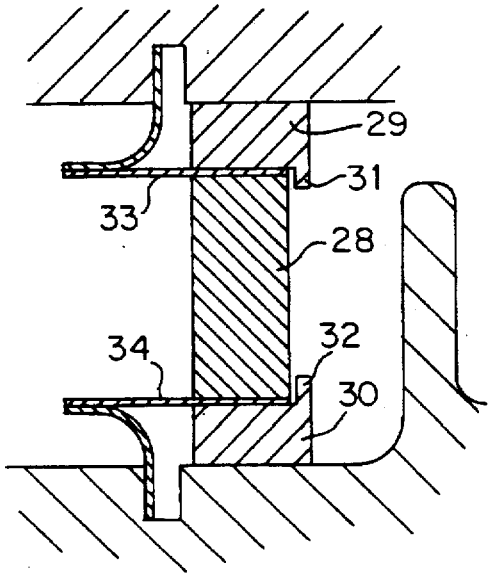
FIGS. 3, and 4 schematically show respective different arrangements in accordance with the invention.

FIG. 3 schematically illustrates part of another embodiment of the Invention which is similar to that shown in FIG. 2*a*. However, in this embodiment, the cylindrical wall 28 is of uniform radial thickness along its axial length and the ceramic rings 29 and 30 include projecting flanges 31 and 32 respectively to provide shielding of the inner edge of the metal rings 33 and 34.

Figure 4:
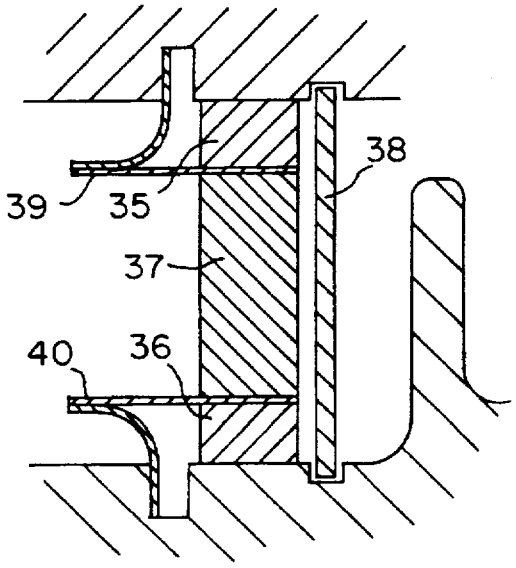

With reference to FIG. 4, another arrangement in accordance with the invention includes two ceramic rings 35 and 36 and a cylindrical wall 37, each of the components being of substantially the same radial thickness. A thin ceramic tube 38 is located co-axially within the wall 37 to provide shielding of the metal ring 39 and 40.

Figure 5:
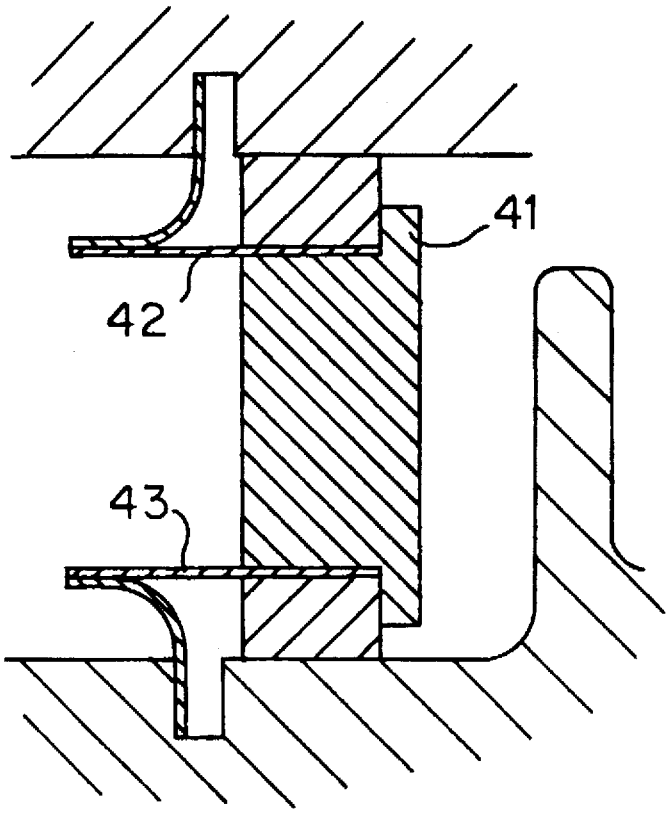
FIG. 5 schematically shows an assembly similar to that of FIG 2*a*.

FIG. 5 schematically shows an assembly similar to that of FIG. 2*a*, but in this embodiment, the ceramic material 41 shielding the inner face of the metal rings 42 and 43 is in contact with them.

In the illustrated embodiments of the invention, the ceramic wall is longer in the axial direction than the ceramic ring or rings. In other arrangements the ceramic ring, or rings, may be of substantially the same axial length as the ceramic wall or may be longer than it.

We claim:

1. An electron beam tube comprising: an electron gun; input means for coupling electromagnetic energy into said tube; output means for coupling electromagnetic energy out of said tube; an interaction structure at which an electron beam propagating from said electron gun interacts with electromagnetic energy coupled into said tube by said input means; and a vacuum envelope, said tube further comprising a ceramic cylindrical wall having an end face; an annular metal ring having an inner periphery; and an annular ceramic ring having an end face, said ceramic wall, said metal ring and said ceramic ring coaxially surrounding an axis along which said electron beam propagates, said metal ring being located between said end face of said ceramic wall and said end face of said ceramic ring, said ceramic wall and said metal ring defining part of said vacuum envelope; and said tube including ceramic material located radially inwardly of said inner periphery of said metal ring and being coextensive with said inner periphery in an axial direction, whereby said ceramic material shields said metal ring from arcing.

2. A tube as claimed in claim 1 wherein said metal ring is mounted on said end face of said cylindrical wall.

3. A tube as claimed in claim 1 wherein said ceramic material is integral with said cylindrical wall.

4. A tube as claimed in claim 3 wherein said cylindrical wall has an inner circumferential surface and an outer circumferential surface and said wall includes an inner axially extensive flange, said inner circumferential surface of said cylindrical wall having an extent along the axial direction of greater longitudinal axial extent than said outer circumferential surface.

5. A tube as claimed in claim 3 wherein said metal ring is mounted on said end face of said wall.

6. A tube as claimed in claim 1 wherein said ceramic material is integral with said ceramic ring.

7. A tube as claimed in claim 6 wherein said metal ring is mounted on said end face of said cylindrical wall.

8. A tube as claimed in claim 1 wherein said ceramic material consists of a tube member located co-axially within said cylindrical wall.

9. A tube as claimed in claim 1 wherein said ceramic material abuts said inner periphery of said metal ring.

10. A tube as claimed in claim 1 further comprising an electrically conductive member located within said vacuum envelope, said ceramic material being located between said member and said metal ring; and means for applying a potential to said member and to said ring and for maintaining said member at a potential sufficiently different from a potential of said metal ring that, in the absence of said ceramic material, arcing would occur therebetween.

11. A tube as claimed in claim 1 further comprising a cylindrical flared member defining part of said vacuum envelope said metal ring being sealingly affixed to said flared member.

12. A tube as claimed in claim 1 further comprising a second ceramic ring and a second metal ring located between said cylindrical wall and said second ceramic ring, and said tube including additional ceramic material, said second metal ring having an inner periphery and said additional material being located radially inwardly of said second metal ring and coextensive with the inner periphery in an axial direction so as to shield said second metal ring from arcing.

13. A tube as claimed in claim 12 wherein said additional ceramic material is contiguous with said ceramic material.

14. A tube as claimed in claim 12 and including means for maintaining said first and second metal rings at substantially different electrical potentials.

15. A tube as claimed in claim 12 wherein at least one of said first and second metal rings is mounted on an end face of said ceramic wall.

16. A tube as claimed in claim 12 further comprising a cylindrical flared member defining a part of said vacuum envelope, at least one of said first and second metal rings being sealingly affixed thereto.

17. A tube as claimed in claim 12 wherein said cylindrical wall defines part of a multi-stage collector arrangement.

18. A tube as claimed in claim 1 wherein said cylindrical wall defines part of a multi-stage collector arrangement.

19. A vacuum envelope for an electron beam tube including an electron gun; input means for coupling electromagnetic energy into said tube; output means for coupling electromagnetic energy out of said tube; and an interaction structure at which an electron beam propagating from said electron gun interacts with electromagnetic energy coupled into said tube by said input means, said vacuum envelope comprising a ceramic cylindrical wall having an end face; and an annular metal ring having an inner periphery; and an annular ceramic ring having an end face, said ceramic wall, metal ring and ceramic ring coaxially surrounding an axis along which said electron beam propagates, with said metal ring being located between said end face of said ceramic wall and said end face of said ceramic ring, said ceramic wall and said metal ring defining part of said vacuum envelope; and said envelope including ceramic material located radially inwardly of said inner periphery of said metal ring and being coextensive with said inner periphery in an axial direction, whereby said ceramic material shields said metal ring from arcing.

20. A multi-staged collector for an electron beam tube including an electron gun; input means for coupling electromagnetic energy into said tube; output means for coupling electromagnetic energy out of said tube; and an interaction structure at which an electron beam propagating from said electron gun interacts with electromagnetic energy coupled into said tube by said input means said collector comprising a plurality of annular electrodes surrounding an axis along which said electron beam propagates; and a vacuum envelope, said collector further comprising a ceramic cylindrical wall having an end face; and annular metal ring having an inner periphery; and an annular ceramic ring having an end face, said ceramic wall, metal ring and ceramic ring coaxially surrounding said axis with said metal ring being located between said end face of said ceramic wall and said end face of said ceramic ring, said ceramic wall and said metal ring defining part of said vacuum envelope;

and said collector including ceramic material located radially inwardly of said inner periphery if said metal ring and being coextensive with said inner periphery in an axial direction, whereby said ceramic material shields said metal ring from arcing.

* * * * *